US006517633B1

(12) United States Patent
Carbonell et al.

(10) Patent No.: US 6,517,633 B1
(45) Date of Patent: Feb. 11, 2003

(54) APPARATUS FOR MENISCUS COATING WITH LIQUID CARBON DIOXIDE

(75) Inventors: Ruben G. Carbonell, Raleigh, NC (US); Joseph M. DeSimone, Chapel Hill, NC (US); Brian J. Novick, Raleigh, NC (US)

(73) Assignees: North Carolina State University, Raleigh, NC (US); The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 09/567,646

(22) Filed: May 9, 2000

Related U.S. Application Data

(62) Division of application No. 09/188,053, filed on Nov. 6, 1998, now Pat. No. 6,083,565.

(51) Int. Cl.[7] ..... B05C 3/02

(52) U.S. Cl. ..... 118/401; 118/404

(58) Field of Search ..... 118/401, 404; 427/434.2, 434.6, 439, 440, 430.1

(56) References Cited

U.S. PATENT DOCUMENTS

| | | | | |
|---|---|---|---|---|
| 4,481,235 A | * | 11/1984 | Foell et al. | 118/401 |
| 4,792,347 A | * | 12/1988 | Deneka et al. | 427/163.2 |
| 4,992,308 A | | 2/1991 | Sunol | 427/297 |
| 5,169,687 A | | 12/1992 | Sunol | 427/297 |
| 5,496,901 A | | 3/1996 | DeSimone | 526/89 |
| 5,512,058 A | | 4/1996 | Gavend et al. | 8/94.18 |
| 5,709,910 A | | 1/1998 | Argyle et al. | 427/434.2 |
| 5,863,612 A | | 1/1999 | DeSimone | 427/422 |
| 5,997,942 A | * | 12/1999 | Chang et al. | 427/163.2 |
| 6,001,418 A | | 12/1999 | DeSimone et al. | 427/240 |
| 6,024,898 A | * | 2/2000 | Steibel et al. | |
| 6,030,663 A | * | 2/2000 | McClain et al. | 427/389.9 |

FOREIGN PATENT DOCUMENTS

| | | |
|---|---|---|
| DE | 4238620 A1 | 5/1994 |
| EP | 0677332 A2 | 10/1995 |
| WO | WO 90/02612 | 3/1990 |
| WO | WO 93/14255 | 7/1993 |
| WO | WO 94/18264 | 8/1994 |
| WO | WO 97/17143 | 5/1997 |
| WO | WO 98/11293 | 3/1998 |
| WO | WO 98/54397 | 12/1998 |
| WO | WO 99/19080 | 4/1999 |
| WO | WO 99/30840 | 6/1999 |
| WO | WO 00/27544 | 5/2000 |

OTHER PUBLICATIONS

Schunk et al.; *Free–Meniscus Coating Processes, Liquid Film Coating. Chapman & Hall. Ed: Stephan F. Kistlec & Peter M. Schweizer (1997) Review of Dip Coating, pp. 673–708.*

* cited by examiner

*Primary Examiner*—Laura Edwards
(74) *Attorney, Agent, or Firm*—Myers Bigel Sibley & Sajovec, P.A.

(57) ABSTRACT

A method of coating a substrate comprises immersing a surface portion of a substrate in a liquid or supercritical first phase. The first phase comprises carbon dioxide and a coating component such as a polymer. The substrate is then withdrawn from the first phase into a distinct second phase such as a gas atmosphere so that the coating component is deposited on said surface portion. The withdrawal step is followed by separating the carbon dioxide from the coating component (e.g., by evaporation, venting, heating, etc.) so that the coating component is retained as a coating layer formed on the surface portion. Apparatus for carrying out the method by free meniscus coating, or employing a metering element such as a knife, blade, or roll, are also disclosed.

5 Claims, 6 Drawing Sheets

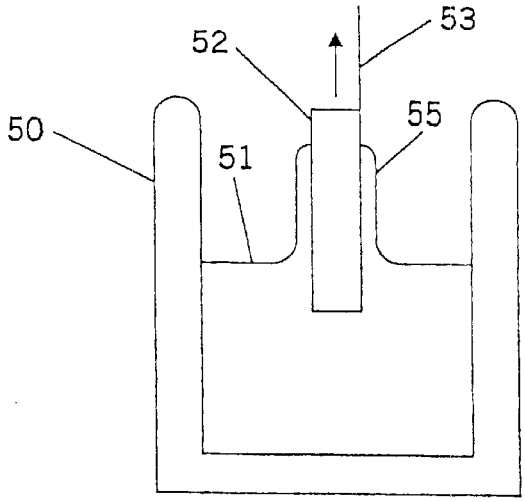
FIG. 5
FIG. 6
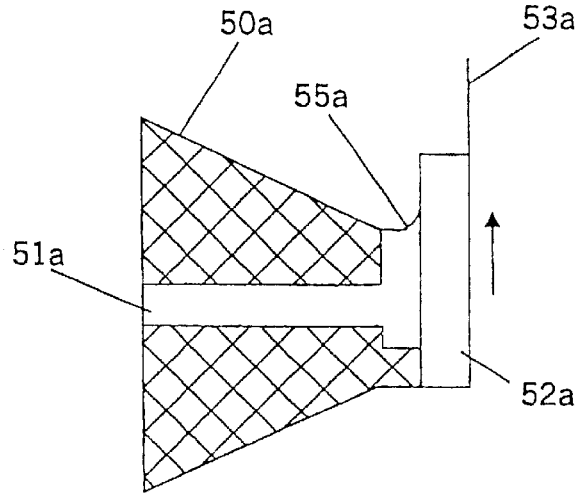
FIG. 7
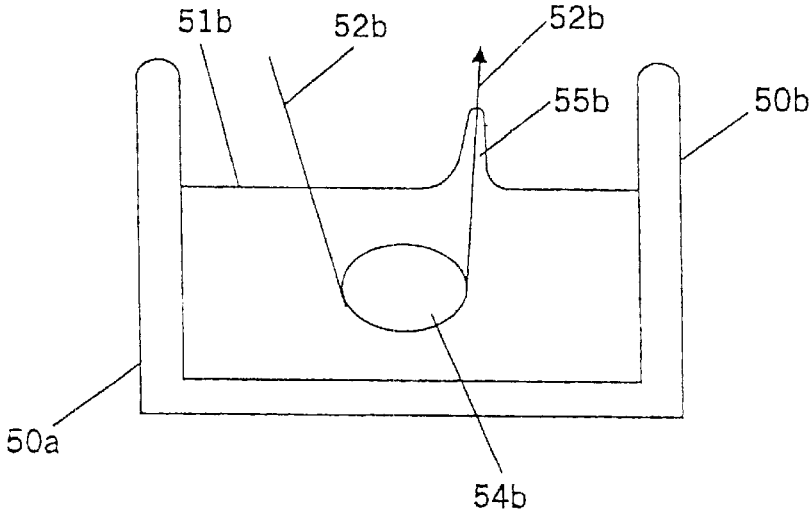

APPARATUS FOR MENISCUS COATING WITH LIQUID CARBON DIOXIDE

CROSS REFERENCE TO RELATED APPLICATION

The instant application is a divisional application of Ser. No. 09/188,053 filed Nov. 6, 1998 now U.S. Pat. No. 6,083,565. The disclosure of this application is incorporated herein by reference in its entirety.

FIELD OF THE INVENTION

The present invention relates to meniscus coating methods and apparatus in which the need to use volatile organic solvents to carry or dissolve the coating material is obviated by the use of a carbon dioxide liquid that contains the coating component.

BACKGROUND OF THE INVENTION

There are three forms of meniscus coating processes which are commonly grouped under the term "free meniscus coating": Withdrawal processes, drainage processes, and continuous processes. Many other coating processes use a meniscus to produce films on the substrate to be coated. These include roll coating, blade coating, and slot coating.

Withdrawal coating (often referred to as dip coating) is the most common free meniscus technique used in both laboratories and industry because of its simplicity and cost. Continuous coating is often desirable because of higher output, but the complicated engineering involved often prevents it from being utilized. Drainage is based upon the same principles as withdrawal and is advantageous when space is limited since it requires no mechanical lifting mechanism. See, e.g., C. Brinker et al., in *Liquid Film Coating,* 673–708 (S. Kistler and P. Schweizer eds. 1997).

Free meniscus coating is a solvent intensive process and accounts for a considerable use of environmentally undesireable solvents. Accordingly, there is a need for new free meniscus coating methods and apparatus that reduce or eliminate the use of solvents such as VOCs and the use of solvents such as CFC, HCFC, HFC, or PFC solvents, as well as aqueous solvents.

SUMMARY OF THE INVENTION

A method of coating a substrate having a surface portion comprises immersing a surface portion of a substrate in a first phase, the first phase comprising carbon dioxide and a coating component such as a polymer; and then withdrawing the substrate from the first phase into a distinct second phase so that said coating component is deposited on said surface portion. In general, the first phase is a liquid or a supercritical fluid (with supercritical fluids preferred for polymer melts), and the second phase is a gas. The withdrawal step is typically followed by the step of separating the carbon dioxide from the coating component (e.g., by evaporation, venting, heating, etc.) so that the coating component is retained as a coating layer formed on the surface portion.

A second aspect of the invention is an apparatus useful for coating a substrate, comprising: a high pressure carbon dioxide supply vessel; a high pressure cell coating vessel connected to the carbon dioxide supply vessel and configured to contain separate and distinct first and second phases therein, the first phase comprising liquid or supercritical carbon dioxide; a holding device for engaging a substrate to be coated in the coating vessel; and a drain system, a batch or continuous mechanical withdrawal assembly, or other withdrawal means operatively associated with said holding device for removing a surface portion of said substrate from said first phase to said second phase in said coating vessel.

A third aspect of the present invention is an apparatus useful for coating a substrate, comprising: a high pressure carbon dioxide supply vessel; a high pressure coating vessel connected to the carbon dioxide supply vessel for containing a liquid or supercritical fluid comprising carbon dioxide and a coating component; a roller assembly, conveyor line, moving table or other such substrate supply means for moving a substrate to be coated in a direction of travel; a feed line connected to the coating vessel and configured to deposit the liquid or supercritical fluid on said substrate at a predetermined location along the direction of travel; and a blade, knife, roll, or other such metering means operatively associated with the supply device for metering the amount of said liquid or supercritical fluid deposited on the substrate.

The foregoing and other objects and aspects of the present invention are explained in greater detail in the drawings herein and the specification set forth below.

BRIEF DESCRIPTION OF THE DRAWINGS

FIG. 5 illustrates a withdrawal or dip free meniscus coating method of the present invention.

FIG. 6 illustrates a slot free meniscus coating method of the present invention.

FIG. 7 schematically illustrates a continuous withdrawal free meniscus coating method of the present invention.

DETAILED DESCRIPTION OF THE PREFERRED EMBODIMENTS

Figure 1:
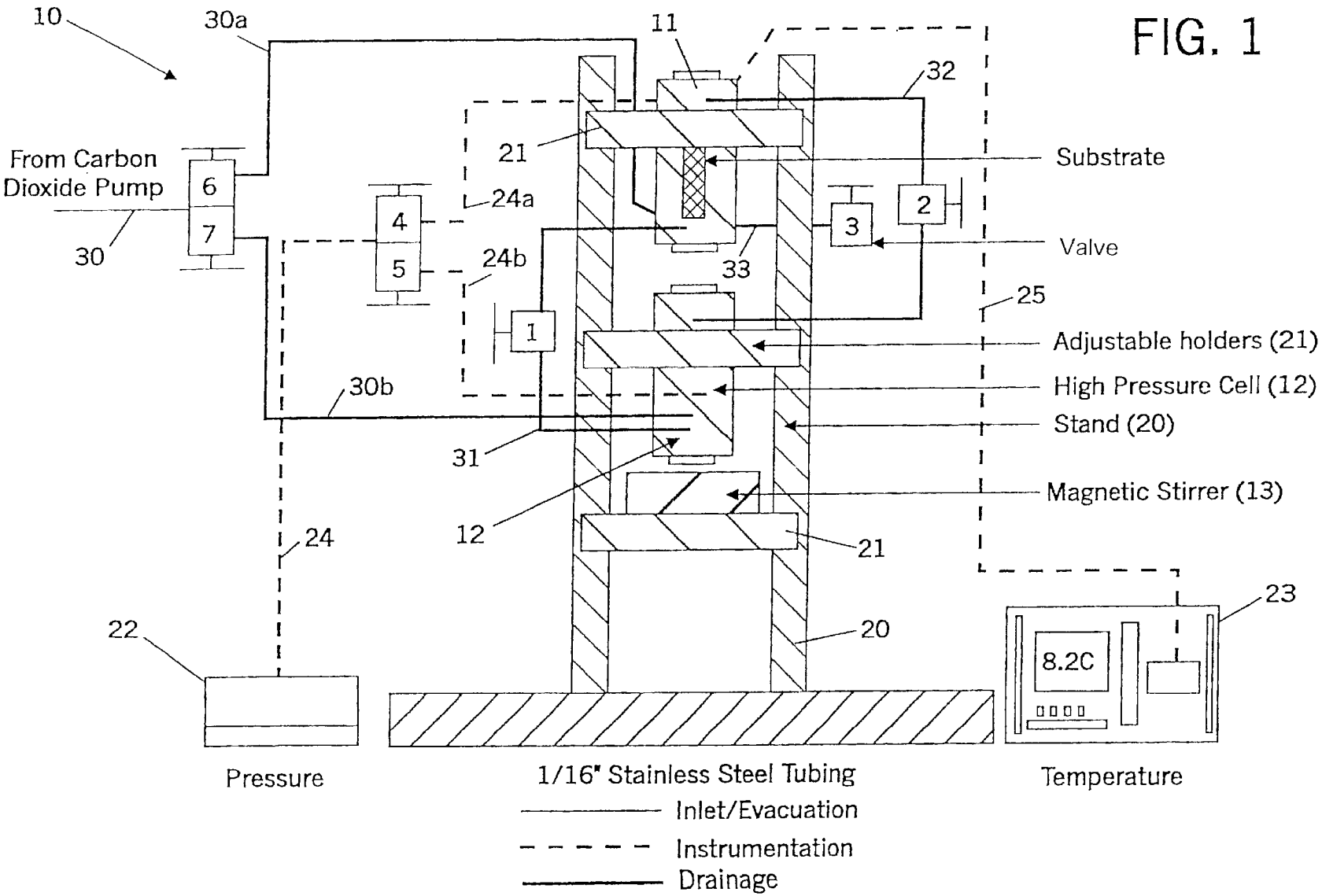
FIG. 1 is an illustration of an apparatus useful for carrying out the present invention.

Substrates that may be coated by the present invention include, but are not limited to, solid substrates, textile substrates, and fiber substrates. The surface portion of the substrate that is coated may be the entire surface of the substrate or any region thereof, such as one side of the substrate, a major or minor portion of the substrate surface, etc.

Solid substrates or articles may be porous or nonporous and are typically formed from metal, semiconductor (such as a silicon wafer) glass, ceramic, stone, composites (typically formed from materials such as carbon fiber, glass fiber, kevlar fiber, etc. filled with a material such as epoxy resin), polymers such as thermoset and thermoplastic polymers (which may be provided in any form such as a polymer film, a molded article, etc.), wood (including but not limited to veneer and plywood), paper (including but not limited to cardboard, corrugated paper and laminates), etc. Such solid substrates may take any form, including electronic components such as circuit boards, optical components such as lenses, photographic film, etc.

Fibers are linear materials (with or without sizing) that have not yet been formed into textile materials, and include natural and synthetic fibers such as wool, cotton, glass and carbon fibers. The fibers may be in any form, such as thread, yarn, tow, etc.

Fabrics or textiles that may be coated by the method of the invention include woven (including knit) and nonwoven fabrics or textiles, formed from natural or synthetic fibers as discussed above, as well as other nonwoven materials such as glass mats.

Wallpaper and carpet (particularly the back surface of carpet) may also be coated by the method of the present invention, for example to apply a stain-resistant fluoropolymer coating to the wallpaper.

The thickness of the coating formed on the subject after evaporation of the carrier solution (the carbon dioxide along with any other compressed gases or cosolvents) will depend upon the particular coating component employed, the substrate employed, the purpose of the process, etc., but can range between about five or ten Angstroms up to one or five millimeters or more. Thus, the present invention provides a means for forming on substrates uniform thin films or layers having thicknesses of five or ten Angstroms up to 500 or 1,000 Angstroms, uniform intermediate thickness films or layers of having thicknesses of about 500 or 1,000 Angstroms up to 5, 10 or 100 microns, and uniform thick films having thicknesses of about 10, 100 or 200 microns up to 1 or even 5 millimeters.

Coating components that may be coated on substrates by the present invention include adhesives such as ethylene vinyl acetate copolymer polymers such as conductive polymers, antiglare materials, optical coatings, antireflective coatings, etc. More particularly, the coating component may be a polyurethane, a sol-gel precursor, a polyimide, an epoxy, a polyester, a polyurethane, a polycarbonate, a polyamide, a polyolefin, a polystyrene, acrylic latex epoxy resins, novolac resins, resole resins, polyurea, polyurea urethanes, polysaccharides (such as cellulose and starch), etc., including mixtures thereof. The amount of the coating component contained in the liquid will depend upon the particular object of the process, the thickness of the desired coating, the substrate, etc., but is in general from about 0.001, 0.01 or 0.1 percent to 10, 20, or 40 percent by weight (or more, particularly in the case of melts as described below).

The carbon dioxide liquid or supercritical fluid may be in any suitable form, such as a solution or a heterogeneous system (e.g., a colloid, a dispersion, an emulsion, etc.). Liquid systems are preferred for such solutions or heterogeneous systems. The liquid may be a melt of a coating component (e.g., a polymer such as polycarbonate), which has been heated to melt that component and then swollen by the addition of liquid or supercritical carbon dioxide to decrease the viscosity thereof. Supercritical fluids are preferably used with such melts. The liquid may contain a giant aggregate or molecule (the "gel") that extends throughout a colloidal dispersion (or "sol", as in liquids used to form sol-gel films.

Carbon dioxide is a gas at standard pressures and temperatures. One feature of a free meniscus coating method of the present invention is, accordingly, that the carbon dioxide system is provided to the substrate as a liquid. This is necessary because the liquid must spread on the substrate and the volatile components must evaporate from the substrate leaving behind the non-volatile film-forming material. Where the carbon dioxide is utilized as a solvent, this is also necessary to prevent the carbon dioxide from evaporating too quickly to remove the compound to be removed from the substrate.

In one embodiment, the carbon dioxide liquid is comprised of carbon dioxide and a fluoropolymer, and more preferably a fluoroacrylate polymer, as the coating component, so that the substrate is coated with the fluoropolymer or fluoroacrylate polymer. Examples of such mixtures are disclosed as the polymerization product described in U.S. Pat. No. 5,496,901 to DeSimone, the disclosure of which is incorporated herein by reference.

In another embodiment, the carbon dioxide liquid is comprised of carbon dioxide and a carbon dioxide insoluble polymer as the coating component dispersed in the carbon dioxide to form a heterogeneous mixture such as a colloid, dispersing being done by the application of shear forces (such as by stirring with a stirrer) or by the addition of surfactants, such as those disclosed in U.S. Pat. No. 5,312,882 or U.S. Pat. No. 5,676,705. This technique enables the coating of substrates with carbon dioxide insoluble polymers.

In another embodiment, the first phase is a liquid melt of a polymer that contains or is swollen with liquid or supercritical carbon dioxide, as noted above. The first phase may thus be heterogeneous or homogeneous. This embodiment is particularly useful for polymers that are not soluble in the carbon dioxide, but can be swollen with carbon dioxide to reduce the viscosity of the polymer. In this embodiment, the second phase may be either a gas or supercritical carbon dioxide.

The carbon dioxide liquid may contain a viscosity modifier such as an associative polymer to increase the viscosity thereof and alter the thicknesss of the surface coating. The viscosity modifier may, for example, be included in an amount sufficient to increase the viscosity of the carbon dioxide liquid up to about 500 or 1000 centipoise.

The carbon dioxide liquid may contain a surface tension modifier (e.g., a surfactant) to increase or decrease the surface tension by an amount up to about plus or minus 5 dynes per centimeter. Surfactants used as such surface tension modifiers should include a $CO_2$-philic group and a $CO_2$-phobic group and are known in the art. See, e.g., U.S. Pat. No. 5,312,882 to DeSimone et al.; U.S. Pat. No. 5,683,977 to Jureller et al. (the disclosures of which are incorporated by reference herein in their entirety).

The carbon dioxide liquid may contain a co-solvent that evaporates more slowly than does carbon dioxide (e.g., alcohols, ketones such as cyclopentanone, butyl acetate, xylene). Substrates coated with such a carbon dioxide liquid may then be removed from the pressure vessel and dried in a drying oven.

The particular details of the coating method will depend upon the particular apparatus employed. In general, the method is implemented as a free meniscus coating process, such as a dip or withdrawal coating process, a slot coating process, or a drainage process. The processes may be batch or continuous. In general, in free meniscus coating processes, the substrate is withdrawn from the liquid into a gas atmosphere, the withdrawal entraining the liquid in a viscous boundary layer that splits into two portions at the free surface of the substrate. Between these two portions is a dividing line referred to as the stagnation line. The liquid portion next to the substrate ends up in the final film formed on the substrate as it is further withdrawn from the liquid, whereas the liquid portion on the other side of the stagnation line is returned to the bath by gravity. The stagnation line is analogous to a metering element such as a blade, knife, or roller. Thus, the present invention may also be employed with processes that use a metering element rather than a stagnation line, as discussed below. In general, in the free meniscus process, the substrate is drawn at a uniform rate of speed from the first phase to the second phase (generally in a substantially vertical direction) so that a uniform meniscus is formed and a uniform film of the first phase material is formed on the substrate along the surface portion to be coated. Drying or removal of the solvent portion of the first phase material then deposits the coating component as a uniform film on the surface portion of the substrate. Alternatively, the drying or removal of the solvent portion of the first phase results in a foamed coating, leaving pores that are continuous or discontinuous in the coating. This can be effected by rapid pressure release or temperature increase.

A first embodiment of an apparatus of the invention employing drainage as the withdrawal means is illustrated in FIG. 1. This figure is discussed in greater detail in Example 1 below. With a drainage method, the apparatus can include a pumping system in conjunction with the drain line to more precisely control the rate of drainage.

A withdrawal or dip coating apparatus for carrying out the present is schematically illustrated in FIG. 5. The vessel 50 contains as a first phase liquid or supercritical fluid comprising carbon dioxide and a coating component 51. The substrate 52 is held in the solution by a clamp 53 while the vessel is filled. Once the vessel is filled, the substrate is withdrawn from the bath by an electrical or mechanical withdrawal mechanism secured to the upper portion of the vessel and connected to the clamp, forming a meniscus 55 along the surface portion to be coated.

A slot coating apparatus is schematically illustrated in FIG. 6. Slot coating is to be considered one type of continuous withdrawal coating herein. The supply nozzle serves as a vessel 50*a* that contains a liquid or supercritical fluid first phase comprising carbon dioxide and a coating component 51*a*. The substrate 52*a* is held with the surface portion to be coated adjacent the liquid by a clamp 53*a* or other carrying means (table, conveyor belt, spool assembly etc.). The substrate is drawn across the liquid or supercritical fluid 51*a* by an electrical or mechanical drawing mechanism, forming a meniscus 55*a* along the surface portion to be coated.

A continuous withdrawal or dip coating apparatus for carrying out the present is schematically illustrated in FIG. 7. As in FIG. 5, the vessel 50*b* contains a liquid or supercritical fluid comprising carbon dioxide and a coating component 51*b*, which serves as the first phase. The substrate 52*b* is held in the solution by a conveying assembly, that includes a roller 54*b* positioned within the bath. The substrate is continuously drawn from the bath by the conveying assembly, forming a meniscus 55*b* along the surface portion to be coated.

In the foregoing apparatus of FIGS. 5–7, supply vessels, supply and drainage lines, heaters, pressure pumps, refrigeration coils, temperature and pressure transducers, control mechanisms, stirring mechanisms and the like may be incorporated as needed to control the atmosphere of the second phase and the conditions of the first phase.

Figure 8:
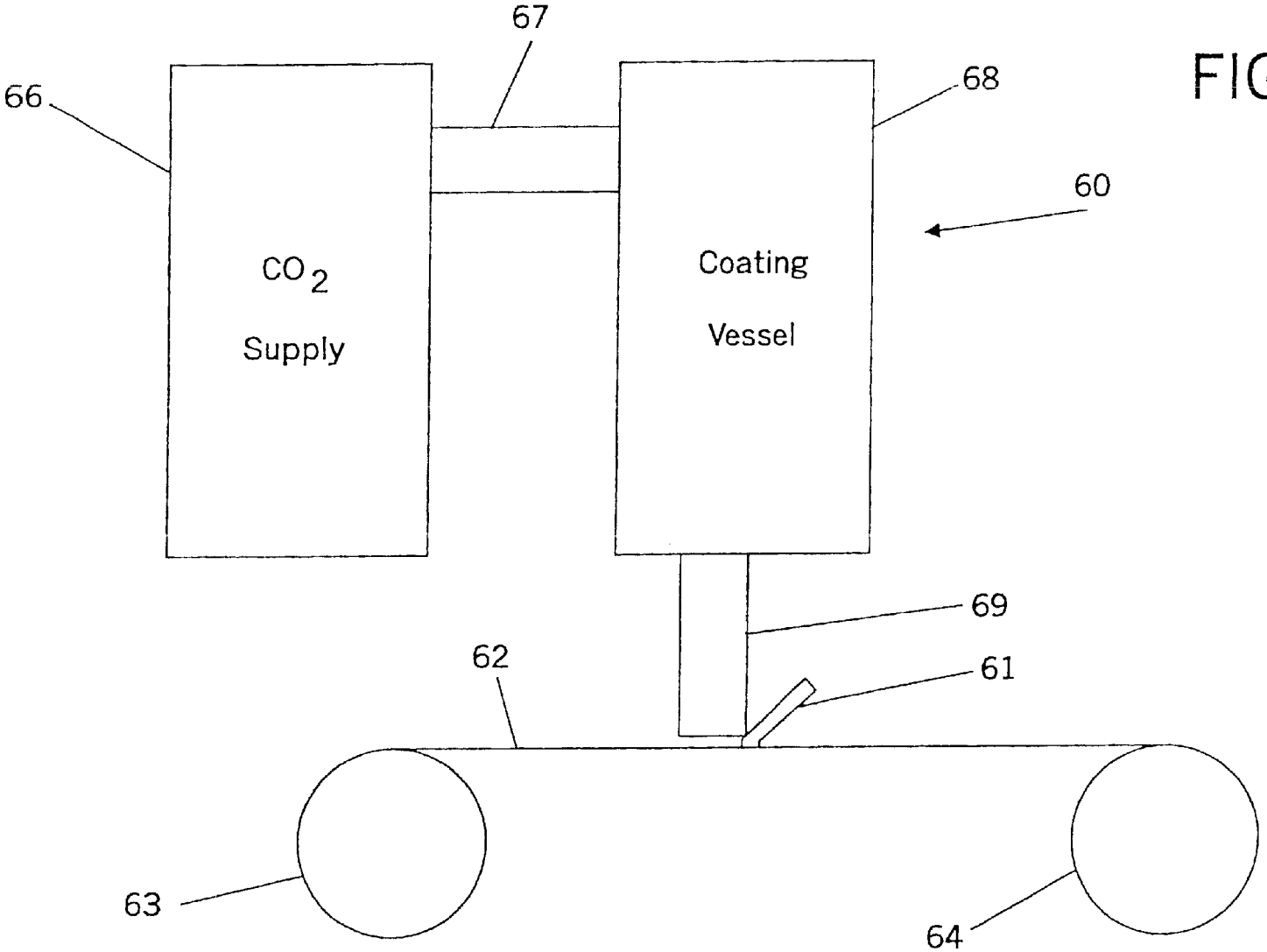
FIG. 8 illustrates a continuous coating method of the invention where a blade or knife serves as a metering element of the coating material rather than the stagnation line of a free meniscus coating method.

The continuous coating apparatus 60 of FIG. 8 employs a metering element 61 (which as illustrated is a knife or blade, but could also be a roll or any other suitable metering element). The substrate 62 is continuously moved from a supply roll or spool 63 to a take up roll or spool 64, which together serve serve as a substrate supply means. Any other substrate supply means could be used, such as a conveyor assembly, table with motorized control elements, and the like. A high pressure carbon dioxide vessel 66 supplies carbon dioxide via line 67 to a high pressure coating vessel 68, in which carbon dioxide and a coating component are mixed. Impellers or other mixing means can be included in the coating vessel, and supply lines for the coating component and other ingredients can also be included into the coating vessel. A feed line 69 connected to the coating vessel supplies the first phase to the substrate, where thickness of the application is controlled by the metering element 61. Depending upon whether the first phase is a liquid or supercritical fluid, the process may be carried out within or outside of a pressure vessel, pressure reduction chambers or baffles may be provided, an air curtain or the like may be provided, etc.

In general, the apparatus is configured so that the substrate is withdrawn from the first phase into an atmosphere comprising or consisting essentially of carbon dioxide at a pressure greater than atmospheric pressure. The atmosphere may comprise or further comprise an inert gas, such as nitrogen. The atmosphere may comprise carbon dioxide at a pressure of 10 to 10,000 psi. Temperature and/or pressure control of the vessel in which coating is carried out is preferably provided to maintain a differential partial pressure of carbon dioxide between said first phase and the second phase/atmosphere of between about 10 and 400 mm Hg.

For solid articles such as metal, stone, ceramic, semiconductor articles and the like, batch or continuous withdrawal coating, drainage coating, or continuous coating with a metering element (FIG. 8) may be used.

For fibers, continuous dip coating is preferred. It is particularly preferred that fibers be provided as a spool of fiber material, which can then be continuously unwound into the first phase, continuously withdrawn into the second phase, and then continuously rewound for subsequent use.

For fabrics, paper, or wood substrates, continuous dip coating or continuous coating with a metering element is preferred. It is particularly preferred that fabrics be provided as a roll of unfinished fabric material, which can then be continuously unwound into the first phase, continuously withdrawn into the second phase, and then continuously rewound for subsequent finishing. Wallpaper and carpets can be treated by a similar process.

While the present invention has been described with carbon dioxide (which is most preferred) as the liquid, any material that is a gas at standard temperature and pressure (STP) but can be transformed to a liquid or a supercritical fluid under increased (i.e., superatmospheric) pressure can be used in combination with, or instead of the, carbon dioxide liquid in the present fluid. The liquid preferably is one that.is not harmful to the atmosphere and is non-toxic towards humans, animals, and plants when vented or released. Other such fluids include $CO_2$, hydrofluorocarbons (HFCs) and perfluorocarbons (e.g., perfluoropropane and perfluorocyclobutane) that are gasses at STP, hydrocarbons that are gases at STP, polyatomic gases, noble gases, and mixtures thereof. Useful polyatomic gases include $SF_6$, $NH_3$, $N_2O$, and CO. Most preferred reaction fluids include $CO_2$, HFCs, perfluorocarbons, and mixtures thereof. Examples of useful HFCs include those that are known to be good solvents for many small organic compounds, especially those HFcs that comprise from 1 to 5 carbon atoms. Specific examples include 1,1,2,2-tetrafluoroethane, 1,1,1,2-tetrafluoroethane, trifluoromethane, and 1,1,1,2,3,3,3-heptafluoropropane. Compatible mixtures of any two or more of the foregoing also can be used as the fluid. $CO_2$ is most preferred, and where mixtures are employed then mixture that comprise at least about 40 or 60 percent $CO_2$ are preferred.

The present invention is explained in greater detail in the following non-limiting Examples.

EXAMPLE 1

Coating Apparatus and Preparation

The purpose of this series of experiments was to determine whether carbon dioxide can be used as a free meniscus coating solvent. The apparatus used is show in FIG. 1 (above). The apparatus 10 comprises an upper high pressure cell 11 and a lower high pressure cell 12. Piping is by 1/16 inch stainless steel tubing. A magnetic stirrer 13 is provided for use in conjunction with a stir bar placed in the lower cell. The apparatus is supported by a support stand 20 and adjustable holders 21. The substrate is held in place with a chuck that is secured to a clamp, and the clamp is connected to the interior of the cell. A pressure sensor 22 and temperature sensor 22 are included, and also connected to respective cells by 1/16 inch stainless steel tubing 24, 24*a*, 24*b*, 25 (shown as dashed lines).

The cells can be filled with carbon dioxide from a carbon dioxide pump (not shown) through lines 30, 30*a*, 30*b* and valves 6 and 7. The fluid can be drained from the 30 top high pressure cell (substrate cell) 11 to the bottom high pressure cell (Solution Cell) 12 along drainage line 31 through valve 1. In the inverted position, fluid can be drained from solution cell 12 to the substrate cell 11 through line 32 and valve 2. When emptied of liquid, cell 11 can be vented through line 33 and valve 3.

The pressure transducer was obtained from Sensotec—Model #060-3147-01; the temperature controller was obtained from Omega—CN76000. Valves 1,2, and 3 were obtained from High Pressure Equipment Company—Model #15-11AF1. Valve 6/7 and valve 4/5 were obtained from High Pressure Equipment Company—Model #15-15AF1. The magnetic stirrer was from LTE Scientific—Catalogue #333-0160-0. The carbon dioxide source pump was obtained from Isco—260D Syringe Pump and Series D Controller. Carbon dioxide gas was obtained from National Specialty Gases, and the substrate (glass slide) was from VWR Scientific Products—Catolog #48311-720.

In use, the solution apparatus is cleaned with hot water and then thorougly scrubbed with acetone. After scrubbing, the cell is sprayed with acetone and allowed to dry. After cleaning, the cell is filled to 900 psi with carbon dioxide and purged. After purging, the cells are filled to 1800 psi and left overnight to dissolve contaminants. After sealing all leaks, the system is purged to atmospheric conditions.

Seven glass slides are cleaned with warm water and dried with a wipe. Each slide is then cleaned with acetone and dried with a wipe. Finally, each slide is sprayed with acetone. After cleaning the slides are placed within clean weigh boats so that they are suspended above the surface and left at room temperature.

The apparatus is placed in a refrigerator until use and then withdrawn. The glass slide is sprayed with acetone and placed in the substrate cell. Poly[1,1-dihydroperfluorooctyl methacrylate] (PolyFOMA) is weighed in four separate samples and the solution cell is filled with those samples (total 0.6047 g) to provide a two weight percent solution, and a magnetic stirrer, and the apparatus returned to a refrigerator at T=5.8° C. The apparatus is removed from the refrigerator and the solution cell filled to 400 psig and evacuated so as not to lose polymer. This is done twice. The substrate cell is filled to 2000 psig and evacuated to clean the apparatus and evacuated to clean the apparatus and slide, and the solution cell is brought to 619 psig. The solution cell is then filled with liquid carbon dioxide at 720 psig to the top inlet and the apparatus placed back in the refrigerator at T=16.1° C. The magnetic stirrer is turned on and the solution is left overnight to allow the polymer to dissolve. The same solution is used for the three runs described below. overnight to allow the polymer to dissolve. The same solution is used for the three runs described below.

EXAMPLE 2

Pressure Release Rate of 1.4 psi Per Second

Figure 2:
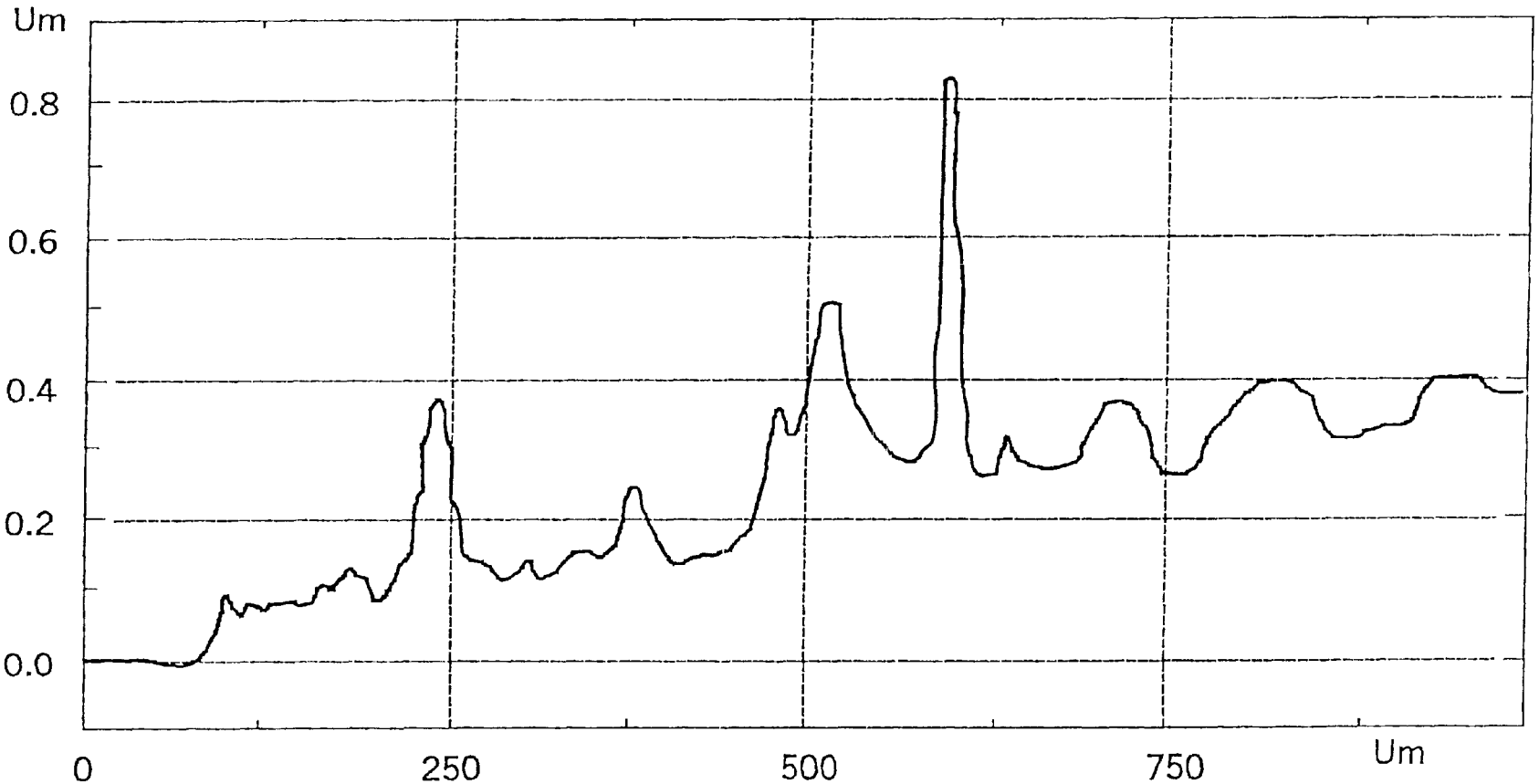
FIG. 2 is a profileometry illustration of a first glass slide coated with polymer by a method of the present invention, with the pressure release rate from the pressure vessel at an average rate of 1.4 psi per second. Sampling was done across the slide in a vertical direction. The maximum thickness of the coating was 0.82 $\mu$m; the minimum thickness of the coating was 0.10 $\mu$m. Both the horizontal and vertical axis are in $\mu$m.
Figure 3:
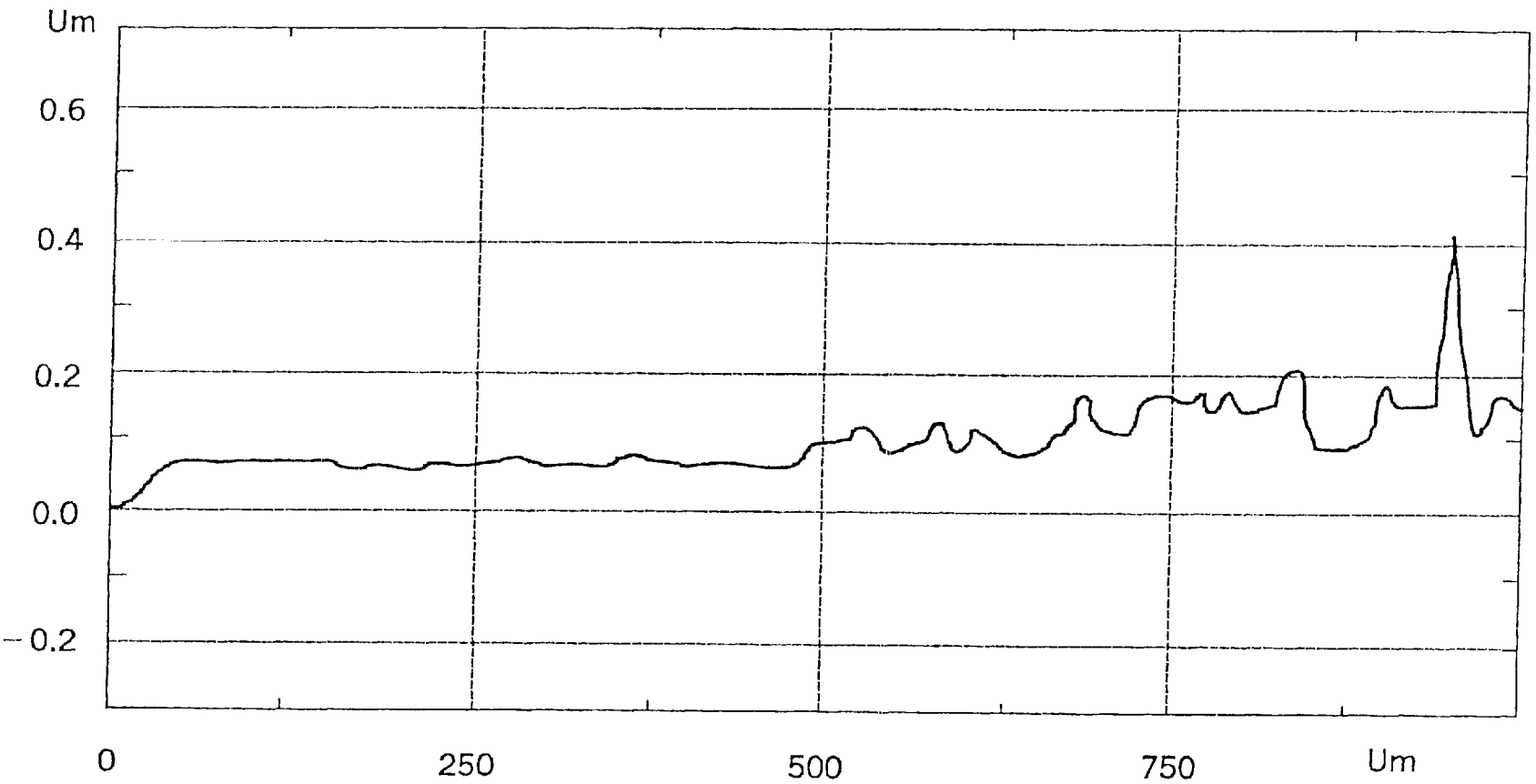
FIG. 3 is a profileometry illustration of the same glass slide described in FIG. 1, with sampling done across the slide in a horizontal direction. The maximum thickness of the coating was 0.41 $\mu$m; the minimum thickness of the coating was 0.13 $\mu$m. Both the horizontal and vertical axis are in $\mu$m.

The apparatus in the refrigerator is filled with clear $CO_2$ and polymer solution at a temperature of 9.1° C. and a pressure of 611 psig. The apparatus is removed from the refrigerator and inverted to allow the liquid to drain to the substrate cell. After about 2 minutes the valves are closed and the apparatus is set upright. The cell is placed back in the refrigerator, the pressure transducer is closed and the system allowed to stabilize. Once the solution has no ripples on the top, drainage is begun by opening valves 1 and 2. After 1 minute and six seconds the drainage valves are closed and the substrate cell isolated, the transducer is opened at the top cell and evacuation is begun at a slow rate of 1.4 psi per second. The glass slide is removed from the apparatus and all valves are closed. A thin film of polymer is found on the glass slide, as illustrated in FIG. 2 and FIG. 3.

EXAMPLE 3

Pressure Release Rate of 0.89 psi Per Second

Figure 4:
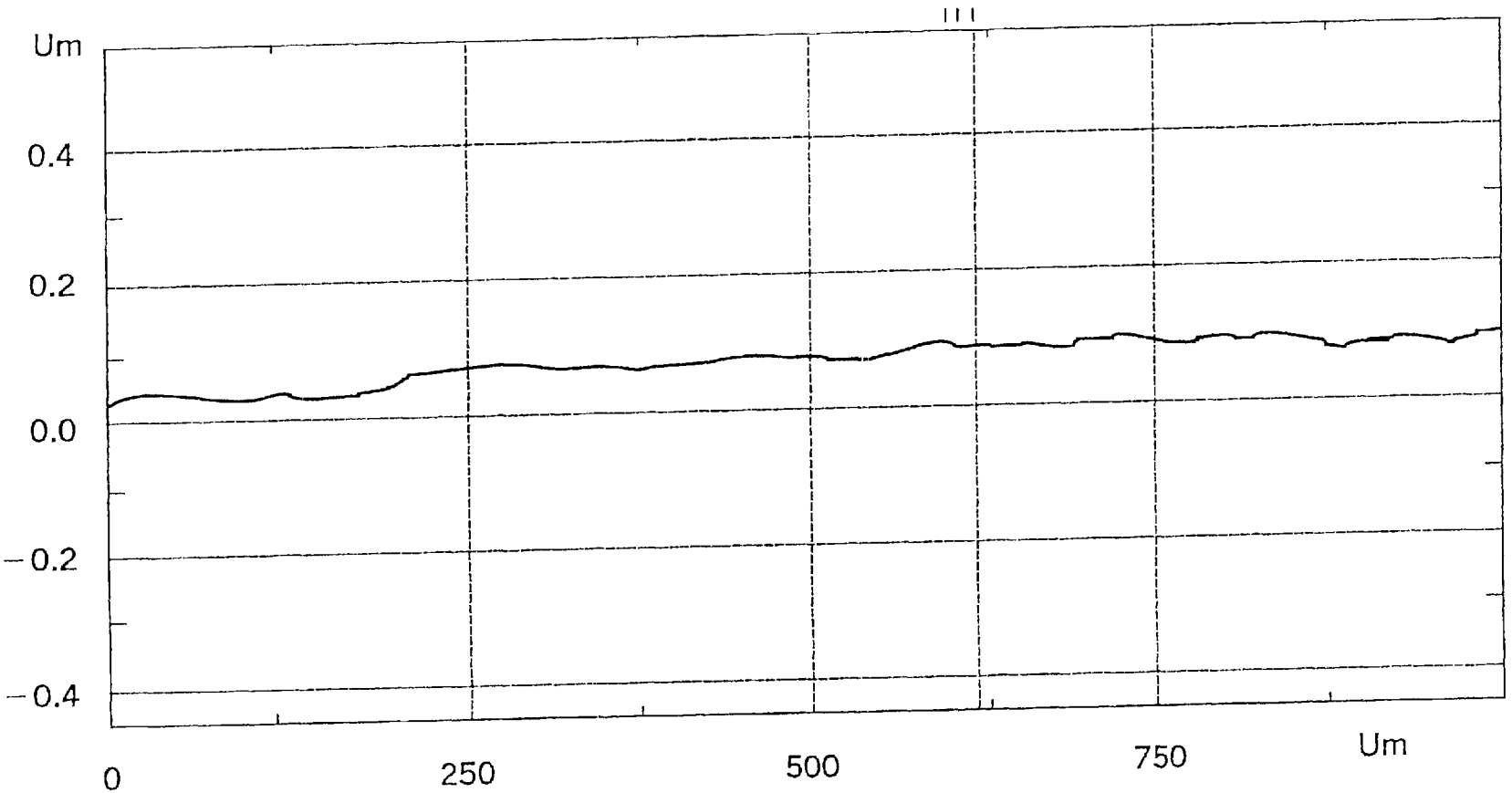
FIG. 4 is a profileometry illustration of a second glass slide coated with polymer by a method of the present invention, with the pressure release rate from the vessel at an average of 0.89 psi per second. The sampling was done across the slide in a vertical direction. Note the smooth uniform surface, with a maximum thickness of 0.14 $\mu$m and a minimum thickness of 0.13 $\mu$m. Both the horizontal and vertical axis are in $\mu$m.

This example is carried out in essentially the same manner as Example 2 above, with the same solution in the apparatus as used in Example 2. The cells were equilibrated at a temperature of 10.4° C. and a pressure of 606 psig. The solution was found to be cloudy, and was allowed to become clear and stable before drainage was begun. Drainage was carried out for one minute and twenty seconds. After the drainage valves are closed, the substrate cell is isolated and evacuation begun at a rate of 0.89 psi/second. The glass slide was removed from the cell. A thin film of polymer is found on the glass slide, as illustrated in FIG. 4. Further reuse of the polymer solution did not result in coated slides, apparently because of the dilution of the solution for these runs.

The foregoing is illustrative of the present invention, and is not to be construed as limiting thereof. Accordingly, the invention is defined by the following claims, with equivalents of the claims to be included therein.

We claim:

1. An apparatus comprising:

a high pressure carbon dioxide supply vessel;

a high pressure coating vessel connected to said carbon dioxide supply vessel and configured to contain separate and distinct first and second phases therein, said first phase comprising liquid or supercritical carbon dioxide;

a holding device for engaging a substrate to be coated in said coating vessel; and withdrawal means operatively associated with said holding device for removing a surface portion of said substrate from said first phase, through a meniscus existing at an interface of said first phase and said distinct second phase, into said distinct second phase so that said meniscus forms a first film phase on said surface portion, wherein said withdrawal means comprises a withdrawal mechanism connected to said holding device such that said withdrawal mechanism is configured to withdraw said holding device from said coating vessel.

2. An apparatus comprising:

a high pressure carbon dioxide supply vessel;

a high pressure coating vessel connected to said carbon dioxide supply vessel and configured to contain separate and distinct first and second phases therein, said first phase comprising liquid or supercritical carbon dioxide;

a holding device for engaging a substrate to be coated in said coating vessel, wherein said holding device comprises a clamp; and withdrawal means operatively associated with said holding device for removing a surface portion of said substrate from said first phase, through a meniscus existing at an interface of said first phase and said distinct second phase, into said distinct second phase so that a first film phase is formed on said surface portion.

3. An apparatus comprising:

a high pressure carbon dioxide supply vessel;

a high pressure coating vessel connected to said carbon dioxide supply vessel and configured to contain separate and distinct first and second phases therein, said first phase comprising liquid or supercritical carbon dioxide;

a holding device for engaging a substrate to be coated in said coating vessel; and withdrawal means operatively associated with said holding device for removing a surface portion of said substrate from said first phase, through a meniscus existing at an interface of said first phase and said distinct second phase, into said distinct second phase so that a first film phase is formed on said surface portion, wherein said withdrawal means comprises a drain for draining said first phase from said coating vessel without depressurizing said coating vessel.

4. An apparatus comprising:

a high pressure carbon dioxide supply vessel;

a high pressure coating vessel connected to said carbon dioxide supply vessel for containing a liquid or supercritical fluid comprising carbon dioxide and a coating component;

substrate supply means for moving a substrate to be coated in a direction of travel;

a feed line connected to said coating vessel and configured to deposit said liquid or supercritical fluid on said substrate at a predetermined location along said direction of travel; and metering means operatively associated with said supply means for metering the amount of said liquid or supercritical fluid deposited on said substrate, wherein said metering means comprises a knife, blade, or roll.

5. An apparatus according to claim 4, wherein said substrate supply means comprises a substrate supply roll and a substrate take-up roll.

* * * * *